United States Patent [19]

Mislan

[11] 4,276,923

[45] Jul. 7, 1981

[54] METHOD FOR PRESSURE CASTING METAL OBJECTS

[76] Inventor: Joseph D. Mislan, 4 Sunset Rd., Lawrenceville, N.J. 08648

[21] Appl. No.: 71,932

[22] Filed: Sep. 4, 1979

[51] Int. Cl.[3] ..... B22D 19/00

[52] U.S. Cl. ..... 164/76; 164/99; 164/113; 164/119

[58] Field of Search ..... 164/76, 87, 91, 97–108, 164/113, 303, 427, 429, 431–434, 119, 120; 29/527.5, 527.6, 527.7; 264/257–259, 271, 273, 274, 300, 313, 338, 334, DIG. 34

[56] References Cited

U.S. PATENT DOCUMENTS

| | | | |
|---|---|---|---|
| 690,723 | 1/1902 | Harris | 164/322 |
| 2,113,074 | 1/1938 | Bate | 164/98 X |
| 2,256,000 | 9/1941 | McNeil | 164/108 X |
| 2,260,593 | 10/1941 | Wettlinger et al. | 164/112 X |
| 2,529,348 | 11/1950 | Mustee | 29/527.6 |
| 2,858,572 | 11/1958 | Burdick | 264/257 X |
| 3,147,587 | 9/1964 | Feibelman | 164/333 X |
| 3,343,590 | 9/1967 | Radd | 164/87 |
| 3,432,293 | 11/1969 | Michael et al. | 164/87 X |
| 3,452,843 | 7/1969 | Smith | 164/108 X |
| 3,559,275 | 2/1971 | Slater | 164/108 X |
| 3,599,314 | 8/1971 | Harrison et al. | 164/76 X |
| 3,703,204 | 11/1972 | Brownstein | 164/87 |
| 3,746,595 | 7/1973 | Leason | 264/251 X |
| 3,890,679 | 6/1975 | Simon | 264/273 X |
| 4,030,537 | 6/1977 | Ward | 164/433 |
| 4,063,869 | 12/1977 | Kelz | 425/574 |
| 4,099,905 | 7/1978 | Nash et al. | 425/542 X |
| 4,121,335 | 10/1978 | Berman et al. | 164/98 X |
| 4,176,447 | 12/1979 | Brennan | 264/251 X |
| 4,216,184 | 8/1980 | Thomas | 264/259 X |

FOREIGN PATENT DOCUMENTS

| | | | |
|---|---|---|---|
| 2444267 | 9/1973 | Fed. Rep. of Germany | 264/266 |
| 24779 | 7/1951 | Finland | 29/527.5 |
| 869416 | 6/1961 | United Kingdom | 264/266 |
| 1075796 | 7/1967 | United Kingdom | 264/266 |

*Primary Examiner*—R. L. Spruill
*Assistant Examiner*—K. Y. Lin
*Attorney, Agent, or Firm*—Neil F. Markva

[57] ABSTRACT

A continuous handling method and apparatus for conveying formed objects on a carrier from one work station to another includes an integrally molded carrier material which is molded or cast with the object and is used to carry the object from one station to another until it is severed therefrom.

20 Claims, 3 Drawing Figures

METHOD FOR PRESSURE CASTING METAL OBJECTS

BACKGROUND OF THE INVENTION

1. Field of the Invention

The present invention relates to formed objects and, in particular, to a means for transporting a molded or cast object from one work station to another without handling.

2. Description of the Relevant Art

The art abounds with different methods and techniques for handling castings in an automated or continuous manner requiring a minimum amount of individual handling of the items cast. Typical of these techniques is the U.S. Pat. No. 3,599,314 issued to George Harrison on Aug. 17, 1971. Harrison discloses a method of casting and forging metal pieces in which the casting metal is caused to engage a support adjacent to the casting mold. Following casting, the cast piece is separated from the mold and carried by the support to a forging station for the forging operation and is thereafter carried by the support to the trimming station where the forged part is separated from the trimmed part. However, as disclosed therein, the casting metal engages a support adjacent to the casting mold and the support never becomes a part of the casting but is instead separated therefrom at a trimming station.

U.S. Pat. No. 3,432,293 to Anthony D. Michael, et al issued on Mar. 11, 1969, discloses a method of casting a bearing lining of an alloy by injecting that component of the alloy having the highest specific gravity into a free-falling stream of the other alloy component, and collecting and solidifying the stream of combined metals on a moving belt or backing for the bearing lining. The disclosure herein contemplates the forming of multiple layers of material with no intermixing, except at the common surface where a bond is formed therebetween. The completed multi-metallic product is then cut or stamped to form a finished bearing or other item. The obtaining of a finished product by means of a particular shaped mold is not disclosed therein.

U.S. Pat. No. 3,452,843 issued to Ray F. Smith on July 1, 1969 discloses a cast metal impeller having expanded metal reinforcement for the disc-like angular body and a sleeve and reinforcement piece for the hub. The cross strips of the expanded metal are capable of longitudinal bending and torsional flexure to accommodate wide temperature changes and large mechanical stresses. However, the metal reinforcement utilized therein is used to strengthen the hub and the angular disc-like body and is inserted in each mold individually at the time of casting each object.

A continuous hand machine for casting balls upon wire crossings is disclosed in U.S. Pat. No. 690,723 to Jonathan Harris on Jan. 7, 1902. Harris discloses a means of joining horizontally disposed wires to vertical wire members at their intersection by casting a metal ball at the joint and thereafter rolling the finished fencing material onto a take-up spool. The casting herein forms an integral part of the horizontal and vertical wires and is never separated therefrom.

The present invention overcomes the shortcomings found in the art by providing a means of carrying objects which have been molded or cast integral therewith from one station to another until they are severed therefrom and ready for use. This eliminates the need for stacking and/or handling each of the pieces as they are removed from the mold and is ideally suited for an automatic type of production line.

SUMMARY OF THE INVENTION

A continuous handling method for formed objects as they move from one station to another, according to the principles of the present invention, includes the steps of providing a carrier material extending between take-up and feed mechanisms with a plurality of work stations disposed therebetween, forming an object by pressure casting or at a work station with the carrier material being integrally included with the formed object moving the carrier material with the object affixed thereon to another work station for cooling, and moving the carrier material with the object thereon to still another work station for removing the object together with a portion of the carrier material molded therewith.

A system for handling formed objects, castings or moldings as they move from one work station to another, according to the principles of the present invention comprises feed mechanism means for paying out a carrier material, take-up mechanism means for receiving the carrier material and storing it, and carrier material means disposed upon the feed mechanism means and operatively coupled to the take-up mechanism means. A work station disposed between said feed mechanism means and said take-up mechanism includes a pressure forming means for casting or molding an object. The object is pressure formed with the carrier material means being an integral part thereof. Another work station is provided which receives the formed object and carrier material means and includes a means for cooling the pressure molded object while still upon the carrier material means. Yet another work station receives the molded object and the carrier material means and includes means for removing the molded object with a portion of the carrier material means therewith.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figures 1, 2, 3:
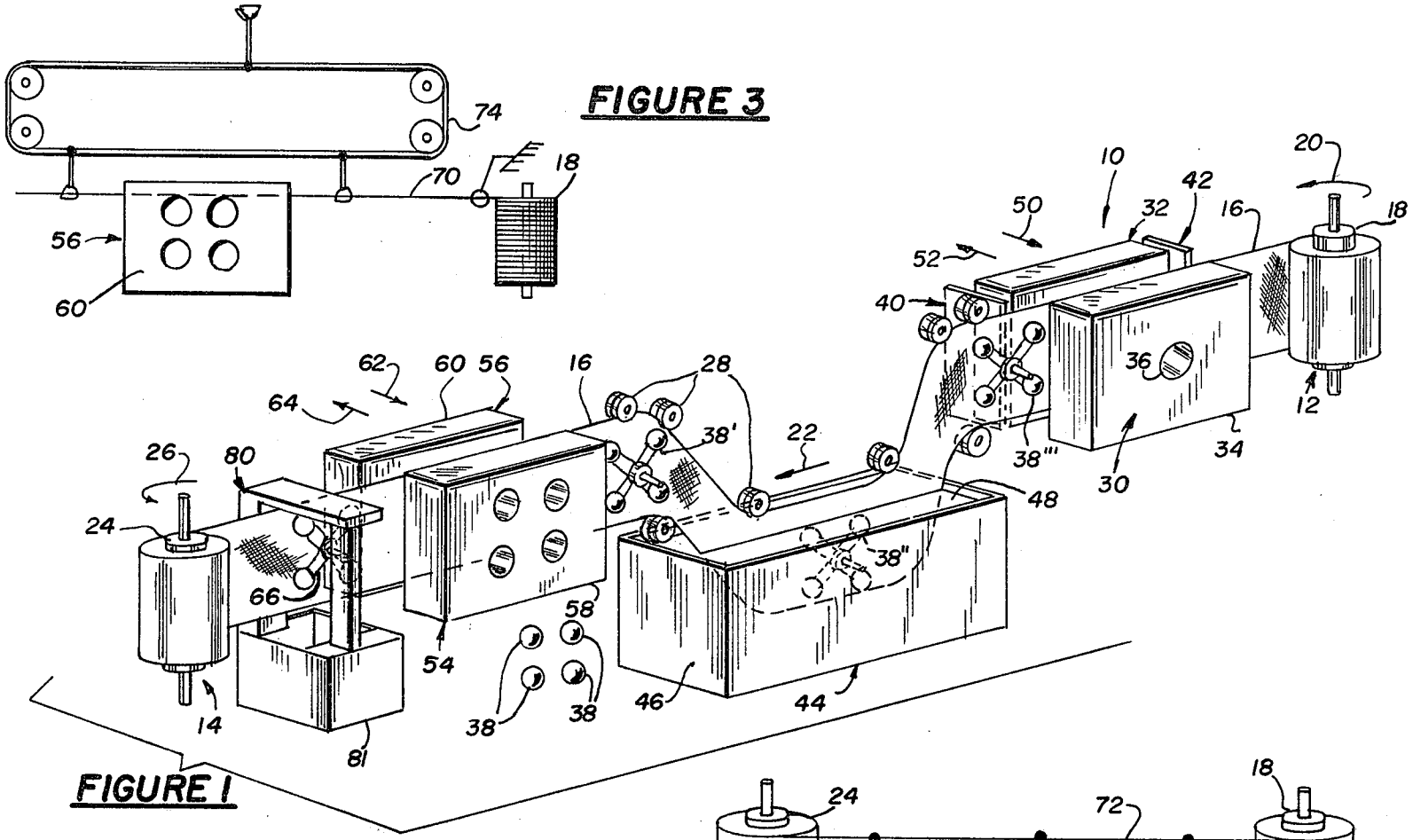
FIG. 1 is a pictorial representation of a casting carrier system, according to the principles of the present invention.
FIG. 2 is a pictorial representation of a single line, or thread carrier.
FIG. 3 is a pictorial representation of an alternative apparatus for maintaining line tension on a single line carrier system.

Referring now to FIG. 1 which shows pictorially a casting carrier system 10. The system 10 includes a feed mechanism 12 and a take-up mechanism 14 which are operatively connected together by a carrier material 16. The feed mechanism includes a cylindrically shaped roller or spool 18 which is coupled to a driving means, not shown, causing it to rotate in the direction of an arrow 20. The rotation of spool 18 permits the carrier material 16 to be dispensed therefrom and moved in the direction of arrow 22 where it is taken up and stored on the spool 24 of the take-up mechanism 14. The take-up mechanism 14 is caused to rotate in the direction of arrow 26 by the drive mechanism associated therewith, not shown. The drive mechanisms for the feed mechanisms and take-up mechanisms are conventional and will not be discussed any further with regard to the present disclosure.

The carrier material is fabricated from a relatively fine flexible wire mesh with a porosity in excess of fifty percent. The continuous, flexible material extends from the feed mechanism 12 to the take-up mechanism 14 with a plurality of work stations placed therebetween. The carrier material 16 may be guided by a plurality of rollers 28 disposed proximate the edge of the carrier material through each of the various work stations, thus providing one continuous path without requiring intervention by any human hands. Alternatively, juxtaposed friction-type rollers may be used on the surfaces of the carrier material to guide it between work stations.

Although a wire mesh configuration has been found to be satisfactory for the system disclosed herein alternative materials may be utilized to fabricate the carrier material, e.g. nylon, teflon, cotton, etc. compatible with the material of the formed object and selected as suitable for its purpose as an integral composite or clad object. A relatively thin solid metallic carrier has also been found successful in certain molding procedures as long as the carrier is capable of being extruded or drawn into the shape required by the mold. Furthermore, a single thread or line of material fabricated from any of the materials set forh hereinbefore may also be utilized between the feed and take-up mechanisms.

A work station includes a die assembly 30 and is generally referred to as a metal die casting station used for pressure forming an object. Assembly 30 includes die halves or sections 32 and 34 with one die half 32 being disposed on one side of carrier material 16 and the other die half 34 being disposed on the other side of carrier material 16. The mold sections 32 and 34 are urged to come together or mate in a conventional manner distorting the carrier material 16 therein in accordance with the internal configuration of the mold pieces. Shortly thereafter, the molten material to be formed into an object is fed into the mold injection aperture or sleeve 36 in a conventional manner.

As is evident in FIG. 1, the vertical disposition of die sections 32 and 34 and the location of sleeve 36 in the center of die section 34 clearly define a type of conventional pressure casting device. Such a conventional device is known to include a pair of pressure casting die sections having an open position and a closed, operative position. When such die sections are in the closed, operative position, a pressure casting die cavity is defined. Thus, the distortion of the carrier material occurs when the flexible material of the carrier is placed between the open die sections 32 and 34 which are then moved to their closed, operative position. As shown, the flexible material of the carrier projects outwardly from the closed die assembly 30. Consequently, a portion of the flexible material is enclosed within the die cavity. The metal die casting technique of this invention is utilized in the casting of metals.

It is also to be noted that although the carrier material is shown disposed in a vertical plane with the forming station generating an object which is essentially formed in a horizontal plane, the present invention is not limited to this configuration and may readily be rotated ninety degrees so that the carrier material may travel in a horizontal plane with the mold providing for an object to be formed in a generally vertical plane or any intermediate plane therebetween.

Once the forming of the object has been completed, the mold is released, in a conventional manner, and the take-up and feed mechanisms caused to rotate, thereby permitting the pressure cast object 38, which has been formed with the carrier material 16, to be moved in the direction of arrow 22. In other words, carrier material 16 is intermittantly fed between the die sections 32 and 34 and to the subsequent work stations as described herein. It is contemplated that the carrier material may be molded onto the object 38 on one surface thereof or may be distorted by the configuration of the molding sections 32 and 34 so that the web material is embedded somewhere within the confines of the object. When the carrier material is maintained on the surface of the formed object it may be used to clad a thin metal onto a plastic or metal. Additionally, a metal may be clad onto both sides of a formed object by providing a second carrier material, in a manner as disclosed herein.

The pressure cast object 38 is stripped away is stripped from the forming mold 32 with the aid of a pair of stripping bars 40 and 42. The bars 40 and 42 remove the formed material from the mold with the aid of ejection rods, not shown, in a conventional manner.

Thereafter the molded object and carrier material is directed towards a cooling or quenching station 44 which may include a reservoir 46 having liquid 48 therein or may be permitted to cool in the atmosphere. The reservoir 46 although shown as a conventional container may be a liquid spray apparatus, of conventional design, not shown, which provides a fine mist directed upon the cast object 38 thereby permitting it to cool down and solidify clear through. When the cast object 38 is positioned to be at the quenching station 44, the forming station 30 operates a second time with the mold portions 32 and 34 moving in the direction of arrow 50 so that it can be in position to receive the molding material and form a second object 38'.

Prior to the movement of the carrier material 16, the die sections 32 and 34 will move to the open position in the direction of arrow 52 releasing the pressure formed object therefrom. Thereafter, the carrier material will move permitting the formed object 38" to enter the quenching station 44 permitting the originally formed object 38 to move to the next work station 54.

Work station 54 includes punch 56 which removes the molded object 38 from the carrier material 16. Punch 56 may be of the conventional type such as a punch and die arrangement having two sections 58 and 60 that move inwardly and outwardly with respect to each other in the direction of arrows 62 and 64. Punch 56 severs the molded object free from the carrier material 16 taking with it a portion of the material, which has been integrally molded with the object 38. Punch 56 moves backwards or outwardly in a conventional manner, in the direction of arrow 64 to free the carrier material for movement onto the take-up mechanism 14. The carrier material 16 is then left with an opening and the unused portion of the raw formed object 66 from which the formed object 38 has been removed .

Station 30 removes the unused portion of the raw casting from the carrier collecting the spent material in a reservoir 81 to be reused in the forming process. A combination of heat and mechanical scrapper would be suitable for the separation.

Thus, the pressure cast object 38 which may be cast or molded has been moved from one station to another without the aid of human hands. The object may be fabricated on a continuously moving carrier system with pauses only permitted as required for the molding, quenching or casting and punching operations, which may occur simultaneously. A finished product is thus provided at the last or punching station once it is released from the carrier material. The carrier material once wound on the take-up mechanism 14 may be removed therefrom and moved to the feed mechanism 12 and re-used until the majority of the carrier material is consumed by being molded into or becoming part of the formed objects 38.

Alternatively, as stated earlier, instead of utilizing a flat sheet of carrier material a single thread or line of material 70, either metal or plastic, may be utilized to carry the molded object as is shown in FIG. 2. An additional line 72 is used to maintain the carrier tension once the object is punched from line 70. Grooves may be provided in the molding portions 32 and 34 to permit the lines to pass therethrough. The thread or line 70 may also be molded with the formed object and carry it until it reaches the punching station 54. Of course, a single line could not be re-used since its continuity would be destroyed once it is punched.

In the embodiment shown in FIG. 3 the line requires a different type of take-up means if it is to be severed by the punch. The take-up apparatus requires an endless belt or chain 74 with mechanical arms 76 spaced apart thereon. The belt and arms are driven in a conventional manner and are adapted to grab line 70 and move the line 70 to the far side of the punching station 56 while maintaining the tension of line 70 after the object is punched therefrom.

Although it is presently contemplated to use a plastic molding material, the system as disclosed herein is suitable for use in casting of metals. Additional heat may be added to the molded object to change its cure time at any point between stations. The quenching station may be eliminated completely with the object permitted to cool down or set at room temperature or forced air of the desired temperature may be applied in a conventional manner.

In addition, a heating station 80 may be added after the punching station 56 to recover any of the molded plastic or metal that remains on the carrier material. The material may be melted from the carrier and returned to the source of molding or casting material in a conventional manner.

Furthermore it is also to be noted that the carrier material may have affixed thereon inserts that can be carried thereon into the mold at the time that the object is molded. These inserts will therefore form an integral part of the object and will be removed therewith when the object is removed from the carrier material.

Having thus set forth the nature of the invention, what is claimed is:

1. A method for pressure casting objects in a metal casting die assembly, said method comprising the steps of:

(a) providing carrier means including a flexible material, (b) providing a metal casting die assembly including a pair of pressure forming die sections having an open position and a closed, operative position, (c) said die sections defining a pressure forming die cavity when the die sections are in the closed, operative position, (d) placing the flexible material between the die sections with the material projecting outwardly from the die assembly when the dies are in the open position, then (e) moving the die sections to the closed, operative position to hold the flexible material in place with the closed die sections to enclose the material of the carrier means within the die cavity, (f) introducing molten metal under pressure into the enclosed die cavity to produce a pressure formed object which integrally includes a portion of the flexible material, (g) engaging the flexible material projecting outwardly from the die assembly to strip the material away from a die section when the die sections are in the open position, and (h) removing the pressure formed object together with the integrally included portion of said flexible material from the carrier means.

2. A method as defined in claim 1 wherein the flexible material is porous to be integrally molded within the pressure formed object.

3. A method as defined in claim 2 wherein the porous material is sparsely woven cloth.

4. A method as defined in claim 2 wherein the flexible material is a relatively high temperature, highly porous flexible laminate.

5. A method as defined in claim 2 wherein the porous material is wire mesh.

6. A method as defined in claim 1 wherein the flexible material is solid sheet material to be integrally molded onto the surface of the pressure formed object.

7. A method as defined in claim 6 wherein the solid, flexible material is metal.

8. A method as defined in claim 1 wherein the flexible material is a single line or thread.

9. A method as defined in claim 1 wherein the flexible material is a relatively fine wire mechanism.

10. A method for pressure casting metal objects, said method comprising the steps of:

(a) providing a carrier means including a continuous, flexible material, (b) providing a plurality of work stations wherein one of the work stations includes a metal casting die assembly having a pair of pressure casting die sections having an open position and a closed, operative position, (c) said die sections defining a pressure casting die cavity when the die sections are in the closed, operative position, (d) intermittently feeding the continuous, flexible material to each of the work stations, (e) enclosing the flexible carrier material within the die cavity at said one work station, (f) introducing molten metal under pressure into the enclosed die cavity to produce a pressure formed object which integrally forms with a portion of the flexible material of said carrier means, (g) moving the pressure cast object to a subsequent work station, and (h) removing the pressure cast object together with the integrally included portion of said flexible material from the carrier means.

11. A method as defined in claim 10 wherein the flexible material is porous to be integrally molded within the pressure formed object.

12. A method as defined in claim 11 wherein the porous material is sparsely woven cloth.

13. A method as defined in claim 11 wherein the porous material is wire mesh.

14. A method as defined in claim 10 wherein the flexible material is a relatively high temperature, highly porous flexible laminate.

15. A method as defined in claim 10 wherein the flexible material is solid sheet material to be integrally molded onto the surface of the pressure formed object.

16. A method as defined in claim 15 wherein the solid, flexible material is metal.

17. A method as defined in claim 10 wherein the flexible material is a single line or thread.

18. A method as defined in claim 10 wherein the flexible material is a relatively fine wire mechanism.

19. A method as defined in claim 10 wherein said moving step includes engaging the flexible carrier material adjacent the die assembly to strip the carrier material away from the die section when the die sections are in the open position.

20. A method as defined in claim 10 wherein said removing step includes severing the pressure formed object from the carrier material by punching through said carrier material with a punching assembly.

* * * * *